US011988089B2

(12) United States Patent
Richards et al.

(10) Patent No.: US 11,988,089 B2
(45) Date of Patent: May 21, 2024

(54) SYSTEMS AND METHODS FOR DOWNHOLE COMMUNICATION

(71) Applicant: Schlumberger Technology Corporation, Sugar Land, TX (US)

(72) Inventors: Edward Richards, Cheltenham (GB); Peter Tutton, Cheshire (GB); Dean Gardner, Bristol (GB); Angie Theresia, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 153 days.

(21) Appl. No.: 17/771,858

(22) PCT Filed: Oct. 29, 2020

(86) PCT No.: PCT/US2020/057988
§ 371 (c)(1),
(2) Date: Apr. 26, 2022

(87) PCT Pub. No.: WO2021/087130
PCT Pub. Date: May 6, 2021

(65) Prior Publication Data

US 2022/0372869 A1 Nov. 24, 2022

Related U.S. Application Data

(60) Provisional application No. 62/928,373, filed on Oct. 31, 2019.

(51) Int. Cl.
*E21B 44/00* (2006.01)
*E21B 47/18* (2012.01)

(52) U.S. Cl.
CPC ..... *E21B 47/18* (2013.01); *E21B 44/005* (2013.01)

(58) Field of Classification Search
None
See application file for complete search history.

(56) References Cited

U.S. PATENT DOCUMENTS 6,089,332 A * 7/2000 Barr ..... E21B 21/10 175/45
7,222,681 B2 * 5/2007 Jones ..... E21B 47/12 73/152.43

(Continued)

FOREIGN PATENT DOCUMENTS

EP 0728909 A2 8/1996
GB 0520733 A1 * 12/1992 ..... E21B 47/027
WO 2016186660 A1 11/2016

OTHER PUBLICATIONS

International Search Report and Written Opinion in International Patent Application No. PCT/US2020/057988, dated Feb. 10, 2021, 11 pages.

*Primary Examiner* — Curtis A Kuntz
*Assistant Examiner* — Jerold B Murphy
(74) *Attorney, Agent, or Firm* — Jeffrey D. Frantz

(57) ABSTRACT

A downhole communication system includes a mud pulse generator that generates a set of pressure pulses in a pattern, the pattern including encoded data. A roll stabilized platform includes a turbine that is rotatable in response to the pressure pulses. The rotational rate of the turbine is correlated with a pressure value. A processor on the roll stabilized platform demodulates the pressure pulse pattern, and then decodes the encoded data.

16 Claims, 9 Drawing Sheets

(56) References Cited

U.S. PATENT DOCUMENTS

| | | | | |
|---|---|---|---|---|
| 8,570,833 | B2 * | 10/2013 | Sugiura | E21B 47/22 340/853.3 |
| 2012/0152533 | A1 * | 6/2012 | Hoefel | E21B 49/088 166/264 |
| 2015/0107903 | A1 * | 4/2015 | Sugiura | E21B 3/00 175/45 |
| 2017/0254190 | A1 | 9/2017 | Jones et al. | |
| 2018/0258702 | A1 * | 9/2018 | Marson | E21B 7/067 |

* cited by examiner

SYSTEMS AND METHODS FOR DOWNHOLE COMMUNICATION

CROSS-REFERENCE TO RELATED APPLICATIONS

This application is a national stage entry under 35 U.S.C. 371 of International Application No. PCT/US2020/057988, filed on Oct. 29, 2020 and titled "SYSTEMS AND METHODS FOR DOWNHOLE COMMUNICATION", which claims the benefit of and priority to U.S. Provisional Patent Application No. 62/928,373, filed on Oct. 31, 2019 and titled "SYSTEMS AND METHODS FOR DOWNHOLE COMMUNICATION", which application is incorporated herein by this reference in its entirety.

BACKGROUND OF THE DISCLOSURE

Downhole drilling tools often rotate to drill, ream, or otherwise degrade material in a downhole environment. Many downhole drilling tools include sections that rotate independently of each other. For example, roll stabilized platforms are often held rotationally stable with respect to a borehole wall, and used in directional drilling applications to provide a reference for an operator on the surface, or a downhole control unit, to direct the bit on a desired trajectory (e.g., to direct the azimuth and/or inclination of the bit). The roll stabilized platform may collect data, such as measurements from sensors, which may be beneficial to communicate from the roll stabilized platform to other portions of a drilling system.

SUMMARY

In some embodiments, a downhole communication system includes a mud pulse generator configured to generate a set of pressure pulses in a drilling fluid in a pattern, the pattern including encoded data. A roll stabilized platform includes a turbine rotatable in response to a drilling fluid pressure. The roll stabilized platform includes a processor and memory, the memory including programmed instructions which, when accessed by the processor, cause the processor to decode the encoded data based on rotation of the turbine.

In some embodiments, a downhole communication system includes a mud pulse generator configured to generate pressure pulses in a pattern, the pattern including encoded data. A rotary steerable system includes a first turbine and a second turbine. One of the first turbine or the second turbine, but not both, is a loaded turbine, loaded with an electromechanical load, the other turbine being an unloaded turbine. The rotary steerable system includes a processor and a memory, the memory including programmed instructions which, when accessed by the processor, cause the processor to determine the unloaded turbine, measure a rotational rate of the unloaded turbine, and decode the encoded data based on the rotational rate.

In yet other embodiments, a method of downhole communication includes generating a set of pressure pulses in a pattern at a measuring-while-drilling (MWD) tool, the pattern including encoded data. The method includes receiving the set of pressure pulses at a rotary steerable system and decoding the encoded data at the rotary steerable system.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
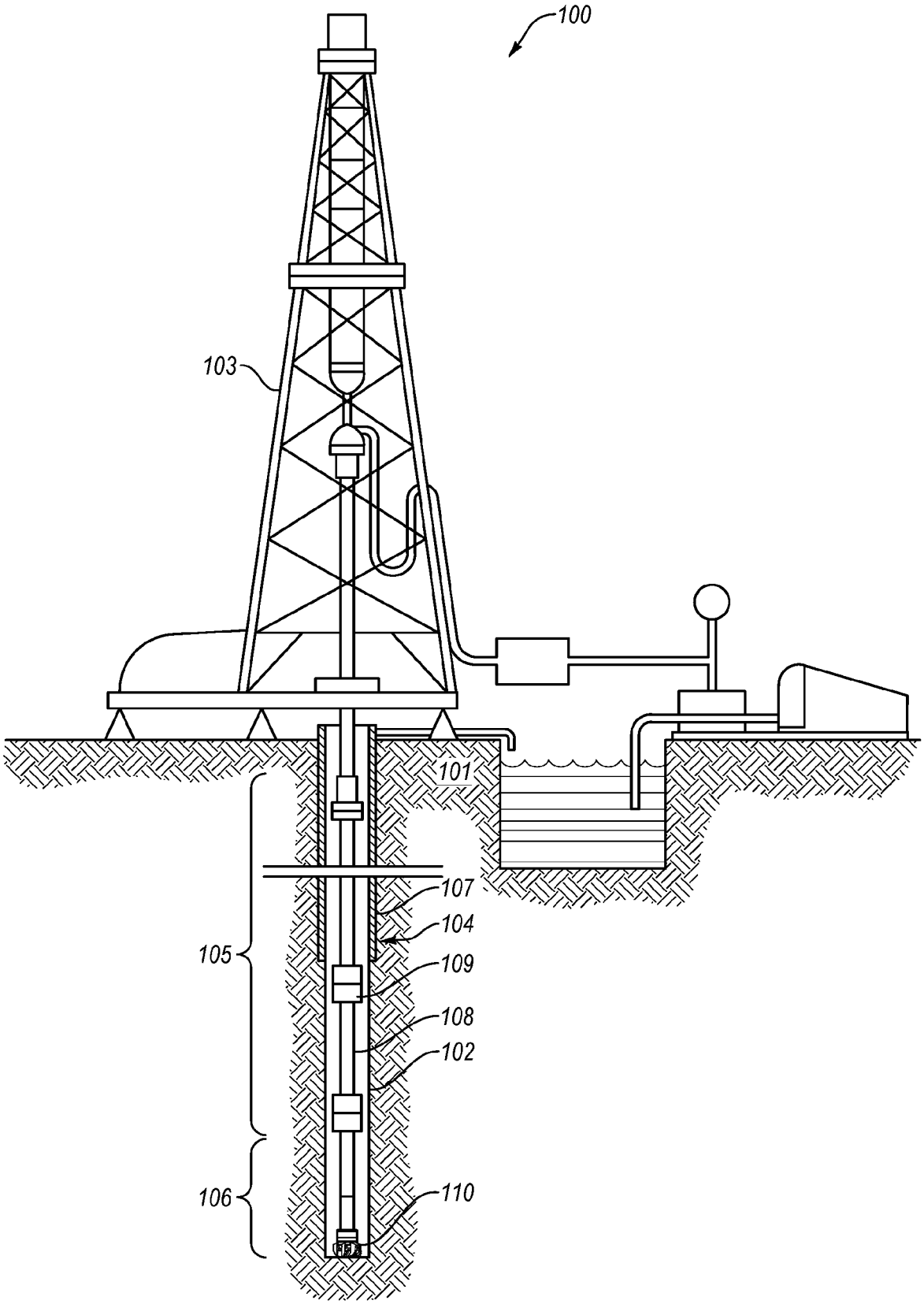
FIG. 1 is a drilling system, according to at least one embodiment of the present disclosure.

This disclosure generally relates to devices, systems, and methods for downhole pressure pulse communication between an MWD and a roll stabilized platform. FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly (BHA) 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between the drill string 105 and the bit 110). Examples of additional BHA components include drill collars, stabilizers, measurement-while-drilling (MWD) tools, logging-while-drilling (LWD) tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface or may be allowed to fall downhole.

Conventionally, communication to roll stabilized platform, such as a rotary steerable system, is performed by a wired connection or by the transmission of an electromagnetic signal. Wired connections require slip rings or the like, which may be prone to erosion, wear, clogging, and so forth. The transmission of electromagnetic signals may be hampered by downhole tools, drilling fluid, the formation, or other factors. Consequently, electromagnetic communication is typically short-range in downhole applications.

Figure 2:
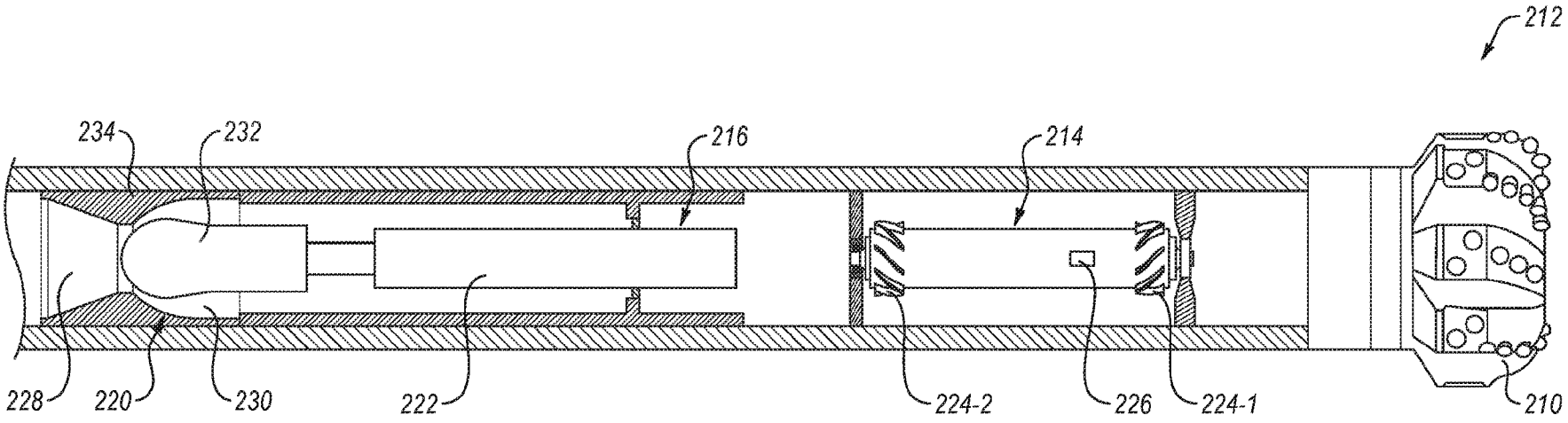
FIG. 2 is a cross-sectional view of a downhole communication system, according to at least one embodiment of the present disclosure.

FIG. 2 is a representation of a downhole communication system 212, according to at least one embodiment of the present disclosure. The downhole communication system 212 may include a roll stabilized platform 214 and a rotating member 216. The roll stabilized platform 214 may include one or more downhole tools, such as an MWD tool, an LWD tool, sensors, a rotary steerable system, components of such tools, or any combination of the foregoing. The rotating member 216 may include, for example, a tubular of a drill string, and/or may include one or more downhole tools 222, such as an MWD tool, an LWD tool, an expandable tool, a mud pulse generator, or any combination of the foregoing.

The rotating member 216 and the roll stabilized platform 214 may rotate at different rotational rates. For example, the rotating member 216 may rotate based on a rotation of the bit 210 or based on a rotation imparted from the drill rig (e.g., the drill rig 103 of FIG. 1). The roll stabilized platform 214 may rotate independently from the rotating member 216 such that it rotates at a different rotational rate than the rotating member 216. For example, in operation, the roll stabilized platform 214 may be selectively held rotationally stationary with respect to an external frame of reference, such as a force of gravity, magnetic north, grid north, true north, the formation, and so forth, to control the direction of drilling (which may vary over the course of a well).

The rotating member 216 may include a mud pulse generator 220. The mud pulse generator 220 may be any type of mud pulse generator capable of generating pressure pulses in a drilling fluid. The mud pulse generator 220 may be operated by the downhole tool 222. The downhole tool 222 may actuate the mud pulse generator 220 such that the mud pulse generator 220 generates a set of pressure pulses in a drilling fluid. The pressure pulses may be generated in a pattern, the pattern including encoded data.

The roll stabilized platform 214 may include one or more turbines (collectively 224), The turbines 224 may be located at any location along the roll stabilized platform 214. For example, a lower turbine 224-1 may be located at a downhole location of the roll stabilized platform 214 (i.e., near the bit 210). In other examples, an upper turbine 224-2 may be located at an uphole location of the roll stabilized platform 214 (i.e., further from the bit 210).

In at least one embodiment, the one or more turbines 224 may be used to maintain a geostationary position of the roll stabilized platform 214. For example, a turbine 224 may be located at both an uphole location and a downhole location of the roll stabilized platform 214. The two turbines 224 may have blades angled such that each turbine rotates in a different direction. One or both of the turbines 224 may selectively transmit a torque to the roll stabilized platform 214. The amount of torque transmitted may determine the rate at which the roll stabilized platform 214 rotates relative to the rotating member 216. In some embodiments, the turbines 224 may apply a torque sufficient to maintain a geostationary position of the roll stabilized platform 214.

The rotational rate of one or both of the turbines 224 may be directly related to the mass flow rate of the drilling fluid, which is related to the hydraulic pressure of the drilling fluid. In other words, when the flow rate is high, the turbines 224 may have a relatively higher rotational rate, and when the flow rate is low, the turbines 224 may have a relatively lower rotational rate. Therefore, by measuring the rotational rate of one or both of the turbines 224, the drilling pressure, and variations thereof, may be calculated or inferred.

A platform control unit 226 may determine the rotational rate of one or both of the turbines 224. The rotational rate of one or both of the turbines 224 may be determined in any number of ways. For example, an optical sensor may determine the velocity of a known diameter of the turbine 224 and may determine the rotational rate of the turbine 224 based on that velocity. In other examples, a sensor may measure the amount of time it takes for the turbine 224 to make a full revolution, and a rotational rate may be determined based on that time. In still other examples, the rotational rate may be determined using any other method to determine a rotational rate.

The platform control unit 226 may then determine the flow rate and infer a hydraulic pressure, or a relative hydraulic pressure value, based on the rotational rate of one or both of the turbines 224. The platform control unit 226 may track multiple rotational rates, and therefore multiple inferred pressures, over a period of time. In this manner, the inferred pressures may be analyzed for a pattern of high inferred pressure and low inferred pressure. The pattern may be the same as the pattern of pressure pulses generated by the mud pulse generator 220. Thus, in at least one embodiment, the platform control unit 226 may determine the pattern based on the rotation or the rotational rate of one or both of the turbines 224.

The platform control unit 226 may demodulate the pressure pulse pattern and decode the encoded data. Therefore, the information communicated by the downhole tool 222 through the mud pulse generator 220 may be received by the roll stabilized platform 214 using the rotation of one or both of the turbines 224. This may be beneficial because the downhole tool 222 may have access to information that the roll stabilized platform lacks. For example, the downhole tool 222 may be an MWD tool including a suite of sensors. At least one of the MWD sensors may measure an MWD measurement different from (e.g., a different type of measurement, a different accuracy of the same measurement, etc.) any platform measurement by a platform sensor located on the roll stabilized platform 214. Therefore, when the downhole tool 222 communicates the MWD measurement, the roll stabilized platform 214 may be able to receive it and analyze it, and potentially make changes to one or more drilling parameters based on the MWD measurement.

The mud pulse generator 220 may have a high pressure side 228 and a low pressure side 230. To generate the high pressure of a pressure pulse, a flow restrictor 232 may restrict flow through a Venturi constriction 234. Therefore, the drilling pressure on the high pressure side 228 may be increased and the drilling pressure on the low pressure side 230 may be decreased.

Many receivers, such as surface receivers located at a surface location, are located on the high pressure side 228 of the mud pulse generator 220. Therefore, many demodulation algorithms used to demodulate the pressure pulse pattern are written assuming the receiver is on the high pressure side 228. The roll stabilized platform 214, and therefore the turbines 224, may be located on the low pressure side 230 of the mud pulse generator 220. Therefore, the pressure pulse pattern experienced by the roll stabilized platform 214 may be inverted from the pressure pulse pattern experienced at the surface. In other words, the turbine 224 may experience a low pressure at the same point in the pattern that the surface receiver would experience a high pressure. Therefore, in at least one embodiment, before demodulating the pressure pulse pattern, the platform control unit 226 may initially invert the determined pressures based on the rotation of one or both of the turbines 224. In this manner, a high determined pressure may be inverted to a low inverted pressure, and a low determined pressure may be inverted to a high inverted pressure. Then the platform control unit 226 may utilize the same demodulation algorithms used by the surface receiver to demodulate the inverted pressure. This may help improve consistency in demodulation between the surface receiver and the platform control unit. After the pattern has been demodulated, the encoded data may be decoded.

In some embodiments, one or both of the turbines 224 may be free-spinning. In other words, one or both of the turbines 224 may not have any resistance to rotation from the drilling fluid other than friction from bearings and other connection points. A turbine 224 that is free-spinning may experience a greater change in rotational rate based on the changes in hydraulic pressure caused by the pressure pulses. This may then increase the difference between the determined high pressure and determined low pressure. A greater difference between the determined high pressure and the determined low pressure may make it easier to demodulate the pressure pulse pattern.

In other embodiments, one of the turbines 224 may be loaded. In other words, the one of the turbines 224 may have an electromechanical load applied, such as an electromechanical load applied when applying a torque to the roll stabilized platform. In this manner, one of the turbines 224 may not be free-spinning. The platform control unit 226 may still measure the rotational rate of the loaded turbine 224, however, the difference in rotational rate between a high pressure and a low pressure may be less pronounced. In other words, a loaded turbine 224 may experience a smaller variation in rotational rate between a high hydraulic pressure and a low hydraulic pressure. Nevertheless, the platform control unit 226 may determine a pressure, invert, and demodulate the pressure pulse pattern, and the encoded data may be decoded based on the loaded turbine. Therefore, the platform control unit 226 may receive information transmitted through the mud pulse generator 220 using both the loaded turbine and the unloaded turbine. In at least one embodiment, both of the turbines 224 may be loaded. In some embodiments, the roll stabilized platform 214 may only include one turbine 224, and in such embodiments, the single turbine can be used as described herein.

Figure 3:
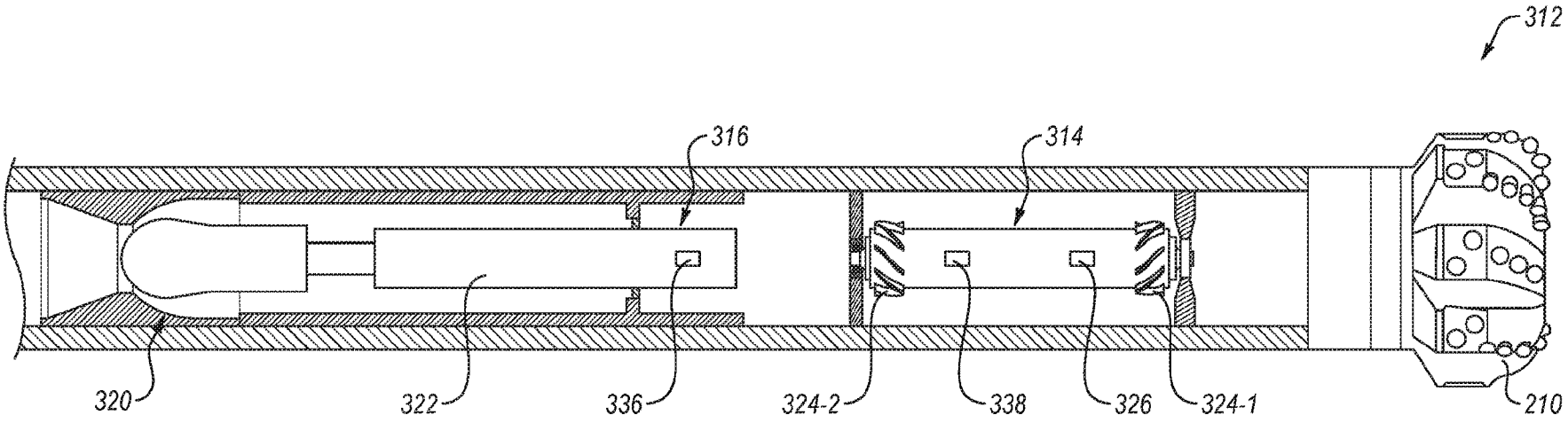
FIG. 3 is another cross-sectional view of a downhole communication system, according to at least one embodiment of the present disclosure.

FIG. 3 is a representation of a downhole communication system 312, according to at least one embodiment of the present disclosure. The downhole communication system 312 may include at least some of the same features and characteristics as the downhole communication system 312 described in relation to FIG. 2. A roll stabilized platform 314 may rotate relative to a rotating member 316. The roll stabilized platform 314 may include a first turbine 324-1 and a second turbine 324-2 (collectively turbines 324). The first turbine 324-1 may be located downhole of the second turbine 324-2, or in other words, the second turbine 324-2 may be located uphole of the first turbine 324-1.

A downhole tool 322 may operate a mud pulse generator 320. The downhole tool 322 may actuate the mud pulse generator 320 to generate pressure pulses in a drilling fluid flowing through the downhole communication system 312 in a pattern, the pattern including encoded data. The turbines 324 may rotate in response to flow rate of the drilling fluid, which is related to the hydraulic pressure. A platform control unit 326 may decode the encoded data based on the rotation of the turbines 324.

Either the first turbine 324-1 or the second turbine 324-2, but not both, may be a loaded turbine. In other words, one of the turbines 324, but not both of the turbines 324, may experience an electromechanical load, such as a load applied when applying torque to the roll stabilized platform 314. The turbine 324-1, 324-2 that experiences the electromechanical load may be the loaded turbine. The turbine 324-1, 324-2 that does not experience the electromechanical load may be the unloaded turbine. For the same hydraulic pressure, the unloaded turbine may rotate at a faster rotational rate than the loaded turbine, and may have a greater difference in rotational rate between high pressure and low pressure.

As discussed above, because an unloaded turbine may have a greater difference in rotational rate between the high pressure and the low pressure, the unloaded turbine may be better suited to determining the hydraulic pressure of the drilling fluid based on the unloaded turbine's rotation. In at least one embodiment, the platform control unit 326 may determine which turbine 324-1, 324-2 is the unloaded turbine and which turbine 324-1, 324-2 is the loaded turbine. The platform control unit 326 may then use the unloaded turbine to demodulate the pressure pulse pattern and decode the encoded data. However, in some embodiments, the platform control unit 326 may use the loaded turbine to demodulate the pressure pulse pattern and decode the encoded data. In some embodiments, the platform control unit 326 may use both the loaded turbine and the unloaded turbine to demodulate the pressure pulse pattern and decode the encoded data.

In some embodiments, the platform control unit 326 may determine which turbine 324-1, 324-2 is the unloaded turbine by determining which turbine 324-1, 324-2 has a faster rate of rotation. In other embodiments, the platform control unit 326 may determine which turbine 324-1, 324-2 is the unloaded turbine by determining which turbine 324-1, 324-2 is applying torque to the roll stabilized platform 314. In yet other embodiments, the turbines 324 may include a status indicator that communicates to the platform control unit 326 if the turbine 324-1, 324-2 is loaded or unloaded. In still other embodiments, the platform control unit 326 may control which turbine 324-1, 324-2 is loaded and which turbine 324-1, 324-2 is unloaded, and therefore may know which turbine 324-1, 324-2 is unloaded. In further embodiments, the platform control unit 326 may use any other mechanism, sensor, or inference to determine which turbine 324-1, 324-2 is loaded or unloaded.

The downhole tool 322 may include an electromagnetic transmitter 336. The electromagnetic transmitter 336 may transmit electromagnetic signals, which may be received by an electromagnetic receiver 338 on the independently rotating platform. In at least one embodiment, the downhole tool 322 may transmit the same data with the electromagnetic transmitter 336 as with the mud pulse generator 320. In this manner, one or both of the electromagnetic signals and the pressure pulses may be a back-up communication pathway for the other. For example, if the electromagnetic receiver 338 is malfunctioning, then the downhole tool 322 may still transmit the data to the roll stabilized platform 314 with the pressure pulses generated by the mud pulse generator 320. In other examples, if the mud pulse generator 320 is malfunctioning, then the electromagnetic transmitter 336 may transmit the data to the roll stabilized platform.

In other embodiments, the downhole tool 322 may transmit different data with the electromagnetic transmitter 336 than with the mud pulse generator 320. For example, a first type of data, such as telemetry information, may be transmitted by the electromagnetic transmitter 336, and a second type of data, such as formation information, may be transmitted by the mud pulse generator 320, or vice versa. Pressure pulses may take more time to transmit the same information than electromagnetic signals. Therefore, in at least one example, the electromagnetic transmitter 336 may transmit more detailed information regarding the same measurement than the mud pulse generator 320 over the same period of time.

Figure 4:
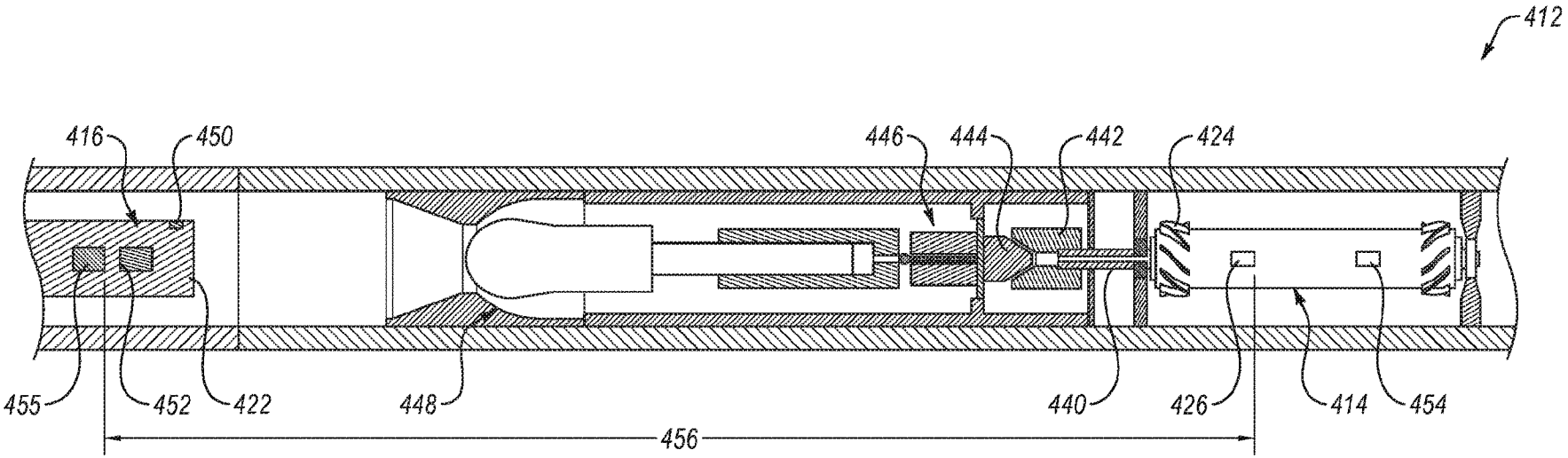
FIG. 4 is yet another cross-sectional view of a downhole communication system, according to at least one embodiment of the present disclosure.

FIG. 4 is a representation of a downhole communication system 412, according to at least one embodiment of the present disclosure. The downhole communication system 412 may include at least some of the same features and characteristics as the downhole communication systems described in relation to FIG. 2 and FIG. 3. In some embodiments, the downhole communication system 412 may include a rotating member 416 and a roll stabilized platform 414. The roll stabilized platform 414 may include a rotary steerable system. An extension 440 from the uphole end of the roll stabilized platform 414 may be connected to a solenoid 442. An actuation member 444 may be spaced apart from the solenoid 442. The actuation member 444 may be connected to an actuation valve 446, the actuation valve 446 actuating a mud pulse generator 448. Therefore, the actuation valve 446 may be a pilot valve for the mud pulse generator 448.

In some embodiments, a downhole tool receiver 450 may be configured to detect the pressure pulses generated by the mud pulse generator 448. In some embodiments, the downhole tool receiver 450 may be any sensor or tool that is capable of detecting a change in drilling pressure caused by pressure pulses, such as pressure pulses generated by the mud pulse generator 448. In at least one embodiment, the downhole tool receiver 450 may be configured to detect a change in drilling pressure caused by pressure pulses propagated from a surface location. Therefore, the downhole tool receiver 450 may be configured to detect any change in drilling pressure, regardless of its source.

In some embodiments, the downhole tool receiver 450 may directly measure pressure of a drilling fluid with a pressure sensor, such as a piston, a diaphragm, a strain gauge, a piezoelectric pressure sensor, an optical fiber, a pressure transducer, a pressure transmitter, or any combination of the foregoing. In the same or other embodiments, the downhole tool receiver 450 may indirectly measure pressure of the drilling fluid. For example, the downhole tool receiver 450 may measure a property of a drilling fluid dependent on the pressure, such as volumetric flow rate or fluid velocity. In other examples, the downhole tool receiver 450 may measure the rotational rate of a turbine or other rotating element whose rotation depends on the velocity and volumetric flow rate of the drilling fluid (which depend on the drilling pressure). Therefore, the downhole tool receiver 450 may be any device configured to detect or measure a change in drilling fluid pressure.

In some embodiments, the downhole tool receiver 450 may be located on a downhole tool 422. For example, the downhole tool 422 may be an MWD or an LWD tool. In other examples, the downhole tool 422 may be an expandable downhole tool, such as an underreamer, a section mill, or a stabilizer. In yet other embodiments, the downhole tool 422 may be a power generation unit, such as a mud motor or a turbine motor. In still other embodiments, the downhole tool 422 may be any tool or sub used on a BHA or in a downhole environment.

In some embodiments, the roll stabilized platform 414 may be located immediately downhole of the downhole tool 422. In other words, the downhole tool 422 may be directly connected to the roll stabilized platform 414 via a mechanical connection, such as a standard threaded pipe connection. In other embodiments, the downhole tool 422 may be located further away from the roll stabilized platform 414. For example, the downhole tool 422 may be one of a plurality of downhole tools, and one or more other downhole tools of the plurality of downhole tools may be located between the downhole tool 422 and the roll stabilized platform 414. In the same or other examples, one or more tubular members may be located between the downhole tool 422 and the roll stabilized platform 414.

The downhole tool 422 may include a downhole tool control unit 452. The downhole tool control unit 452 may be in electronic communication with the downhole tool receiver 450. In other words, the downhole tool receiver 450 may transmit the pressure measurements (or associated measurements) to the downhole tool control unit 452. The downhole tool control unit 452 may identify the pattern of the pressure pulses. After identifying the pattern of the pressure pulses, the downhole tool control unit 452 may decode the information or the data from the pattern. In this manner, the roll stabilized platform 414 may communicate with the downhole tool 422. Therefore, the information from the roll stabilized platform 414 may be communicated to any downhole tool 422 that includes a downhole tool receiver 450.

In some embodiments, the downhole tool control unit 452 may process the information decoded from the pressure pulses received by the downhole tool receiver 450. For example, the information may be a platform measurement measured by a platform sensor 454. A platform control unit 426 may encode the platform measurement into a pattern, and the platform control unit 426 may activate and deactivate the solenoid 442 in the pattern, which may actuate the mud pulse generator 448 in the pattern. Thus, the pattern received by the downhole tool receiver 450 and decoded by the downhole tool control unit 452 may be the platform measurement. In some embodiments, the platform sensor 454 may be any sensor used in downhole tools. For example, the platform sensor 454 may be a trajectory sensor (azimuth and/or inclination), a gamma ray sensor, a resistivity sensor, a tool status sensor (e.g., vibration, strain gauge, temperature), or any other type of sensor.

The downhole tool control unit 452 may then process the platform measurement. For example, the downhole tool control unit 452 may compare the platform measurement to a tool measurement taken by a downhole tool sensor 455. In some embodiments, the platform measurement and the tool measurement may be different measurements. In other embodiments, the platform measurement and the tool measurement may be similar measurements. For example, the platform measurement and the tool measurement may both be trajectory measurements (azimuth and/or inclination). In other examples, the platform measurement and the tool measurement may both be resistivity measurements.

The roll stabilized platform 414 may be located closer to the bit than the downhole tool 422. Therefore, the platform sensor 454 may be closer to the bit than the downhole tool sensor 455. Measurements taken closer to the bit may be more accurate, or at least more representative of conditions at the bit, than measurements taken further away from the bit. Therefore, a difference in conditions between the platform sensor 454 and the downhole tool sensor 455 may be analyzed. In some embodiments, this difference in conditions may provide the downhole tool control unit 452, or an operator at the surface, with an indication of how fast drilling conditions are changing. For example, a difference in gamma ray measurements may indicate that the formation has changed, or if the bit is wandering out of a target formation. In other examples, a difference in resistivity may indicate a change in downhole fluid properties, such as if a downhole water or oil reservoir is encountered. In still other examples, a difference in vibration of different locations of a BHA may indicate how a BHA is performing and provide feedback that may be used during the design of other BHAs.

A sensor distance 456 may be the distance between the platform sensor 454 and the downhole tool sensor 455. The downhole tool control unit 452 may use the sensor distance 456 to analyze the platform measurement. For example, a platform measurement measuring trajectory (azimuth and/or inclination) may be compared to tool measurement measuring trajectory (azimuth and/or inclination). A trajectory difference over the sensor distance 456 may be used to determine the immediate or real-time curvature of the borehole. This curvature information may help prevent the need to wait for the downhole tool sensor 455 to travel the sensor distance 456. Therefore, the downhole tool control unit 452 and/or an operator may have more current or up-to-date information based at least in part on the information from the platform sensor 454.

In some embodiments, the downhole tool control unit 452 may change one or more drilling parameters of the downhole tool 422 (or another downhole tool in communication with the downhole tool 422) based on the platform measurement. For example, if the platform measurement indicates that the bit has reached a target depth or a target formation, then the downhole tool control unit 452 may signal for an expandable tool, such as a section mill or an underreamer, to expand. In other examples, if the platform measurement indicates that the bit is vibrating excessively or experiencing a greater weight on bit than is desired, the downhole tool control unit 452 may send a signal indicating that the rotational rate or the weight on bit should be reduced. In still other examples, if the platform measurement indicates that the bit has wandered off a planned trajectory, the downhole tool control unit 452 may signal for a rotary steerable system to change the trajectory of the drill bit. In yet other examples, the downhole tool 422 may be an expandable tool, and the downhole tool control unit 452 may modify an extension of expandable blades based at least in part on the information decoded from the pressure pulses.

In some embodiments, downhole tool 422 may communicate information to the roll stabilized platform 414 using a mud pulse generator (e.g., mud pulse generator 220 of FIG. 2). In some embodiments, the downhole tool 422 may be configured to operate a different mud pulse generator than the mud pulse generator 448 connected to the roll stabilized platform 414. In other embodiments, the downhole tool 422 may be configured to operate the mud pulse generator 448.

One or more turbines 424 on the roll stabilized platform 414 may rotate in response to the hydraulic pressure of a drilling fluid. The platform control unit 426 may detect any pressure pulses in the drilling fluid based on the rotation of the turbine 424 and decode any data encoded into the pressure pulses. Therefore, the downhole tool 422 may communicate information to the roll stabilized platform 414 using a mud pulse generator. The platform control unit 426 may analyze the decoded information. In some embodiments, the platform control unit 426 may adjust one or more drilling parameters of the roll stabilized platform 414 based on the decoded information. For example, the platform control unit 426 may instruct the rotary steerable system to change a trajectory (inclination or azimuth) of the drill bit based at least in part on the decoded information.

A feedback loop may therefore be created between the roll stabilized platform 414 and the downhole tool 422. The platform sensor 454's platform measurement may be transmitted to the downhole tool 422 by the mud pulse generator 448. The downhole tool control unit 452 may adjust one or more drilling parameter of the downhole tool 422 (or another downhole tool in communication with the downhole tool 422) based at least in part on the transmitted platform measurement. The downhole tool 422 may then transmit the adjusted drilling parameter, an analysis of drilling conditions, and/or a tool measurement from the downhole tool sensor 455 to the roll stabilized platform 414 using a mud pulse generator (either the mud pulse generator 448 or another mud pulse generator). The platform control unit 426 may then analyze the transmitted information and change at least one drilling parameter of the roll stabilized platform 414 based on at least in part on the transmitted information, and so forth.

Figure 5:
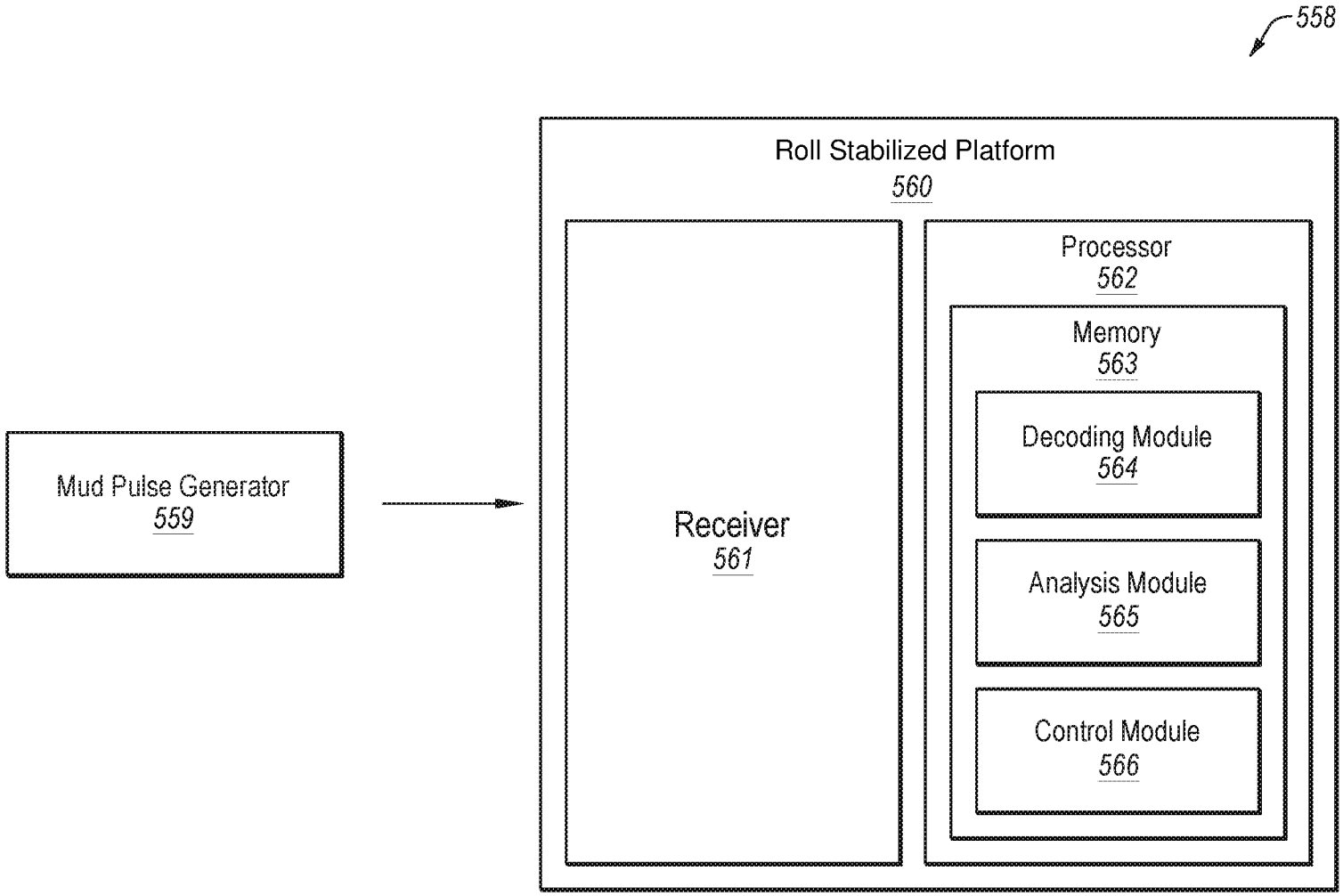
FIG. 5 is a schematic representation of a downhole communication system, according to at least one embodiment of the present disclosure.

FIG. 5 is a schematic diagram of a downhole communication system 558, according to at least one embodiment of the present disclosure. The downhole communication system 558 may include at least some of the same features and characteristics as the downhole communication systems described in relation to FIG. 2 through FIG. 4. The downhole communication system 558 may include a mud pulse generator 559 and a roll stabilized platform 560. The roll stabilized platform 560 may include a receiver 561. A processor 562 on the roll stabilized platform 560 may include memory 563, the memory 563 having programmable instructions in the form of modules that cause the processor 562 to perform actions or routines.

The receiver 561 of the roll stabilized platform 560 may be responsive to the pressure of a drilling fluid. For example, the receiver 561 may be a turbine (e.g., the one or more turbines 224 of FIG. 2), rotatable in response to the hydraulic pressure of the drilling fluid. In other examples, the receiver 561 may be any sensor or mechanism responsive to pressure, such as a pressure sensor or a diaphragm.

The mud pulse generator 559 may generate pressure pulses in a pattern, the pattern including encoded data. The memory 563 of the processor 562 may include a decoding module 564 and an analysis module 565. The decoding module 564 may determine a determined pressure of the drilling fluid based on the response of the receiver 561 to the pressure pulses. The decoding module 564 may then decode the encoded data from the pressure pulses. Because the receiver 561 may be located downhole of the mud pulse generator 559, decoding the encoded data may include inverting the determined pressures. After the determined pressures are inverted, the decoding module 564 may demodulate the pressure pulse pattern, and decode the encoded data based on the demodulated pressure pulse pattern.

The analysis module 565 may analyze the decoded data. The decoded data may include a drilling instruction. Based on the analysis of the decoded data, including the drilling instruction, a control module 566 may change at least one drilling parameter of the roll stabilized platform 560. For example, the control module 566 may change the trajectory of a bore hole using a rotary steerable system.

Figure 6:
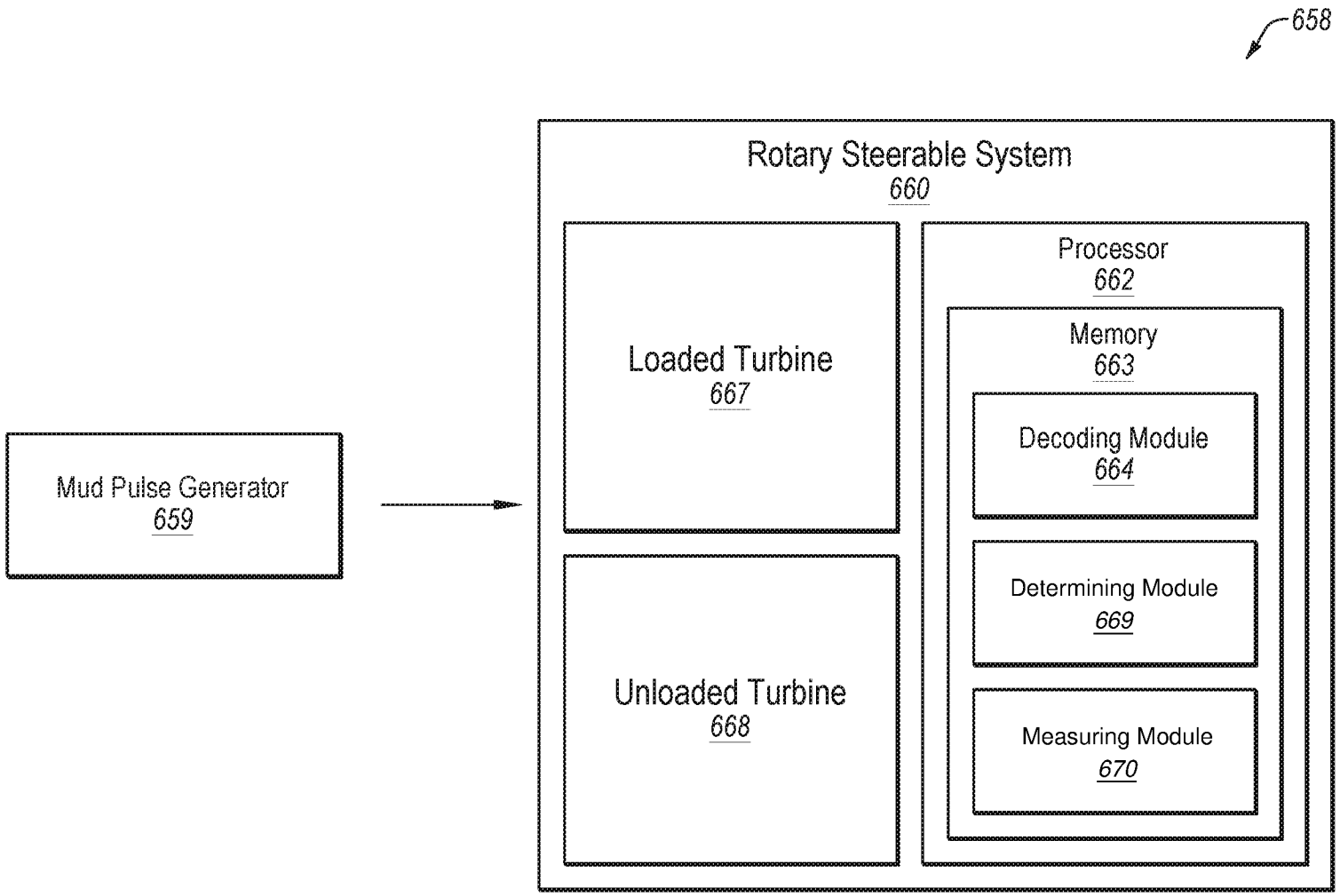
FIG. 6 is another schematic representation of a downhole communication system, according to at least one embodiment of the present disclosure.

FIG. 6 is a representation of a downhole communication system 658, according to at least one embodiment of the present disclosure. The downhole communication system 658 may include at least some of the same features and characteristics as the downhole communication systems described in relation to FIG. 2 through FIG. 5. A mud pulse generator 659 may generate pressure pulses in a pattern including encoded data. A rotary steerable system 660 may include a loaded turbine 667 and an unloaded turbine 668. The loaded turbine 667 and the unloaded turbine 668 may both the rotatable with respect to a pressure of a drilling fluid. Thus, the loaded turbine 667 and the unloaded turbine 668 may rotate faster with a higher pressure and slower with a lower pressure.

A processor 662 on the rotary steerable system 660 may include a memory 663, the memory 663 including instructions in the form of modules which, when accessed by the processor 662, cause the processor to perform tasks. The memory 663 may include a determining module 669. The determining module 669 may determine or identify which turbine of a plurality of turbines is the loaded turbine 667 and which is the unloaded turbine 668. A measuring module 670 may determine the rotational rate of the unloaded turbine 668 based on a measurement from a sensor. A decoding module 664 may then determine a pressure value associated with the measured rotational rate of the unloaded turbine 668. In some embodiments, the decoding module 664 may invert the pressure value. In other embodiments, the decoding module 664 may not invert the pressure value. Based on a series of determined pressure values, the decoding module 664 may identify the pressure pulse pattern, demodulate the pressure pulse pattern, and decode the encoded data of the pressure pulse pattern. In this manner, the rotary steerable system 660 may receive communications from the mud pulse generator 659, which may allow the rotary steerable system to adjust one or more drilling parameters of the rotary steerable system.

Figure 7:
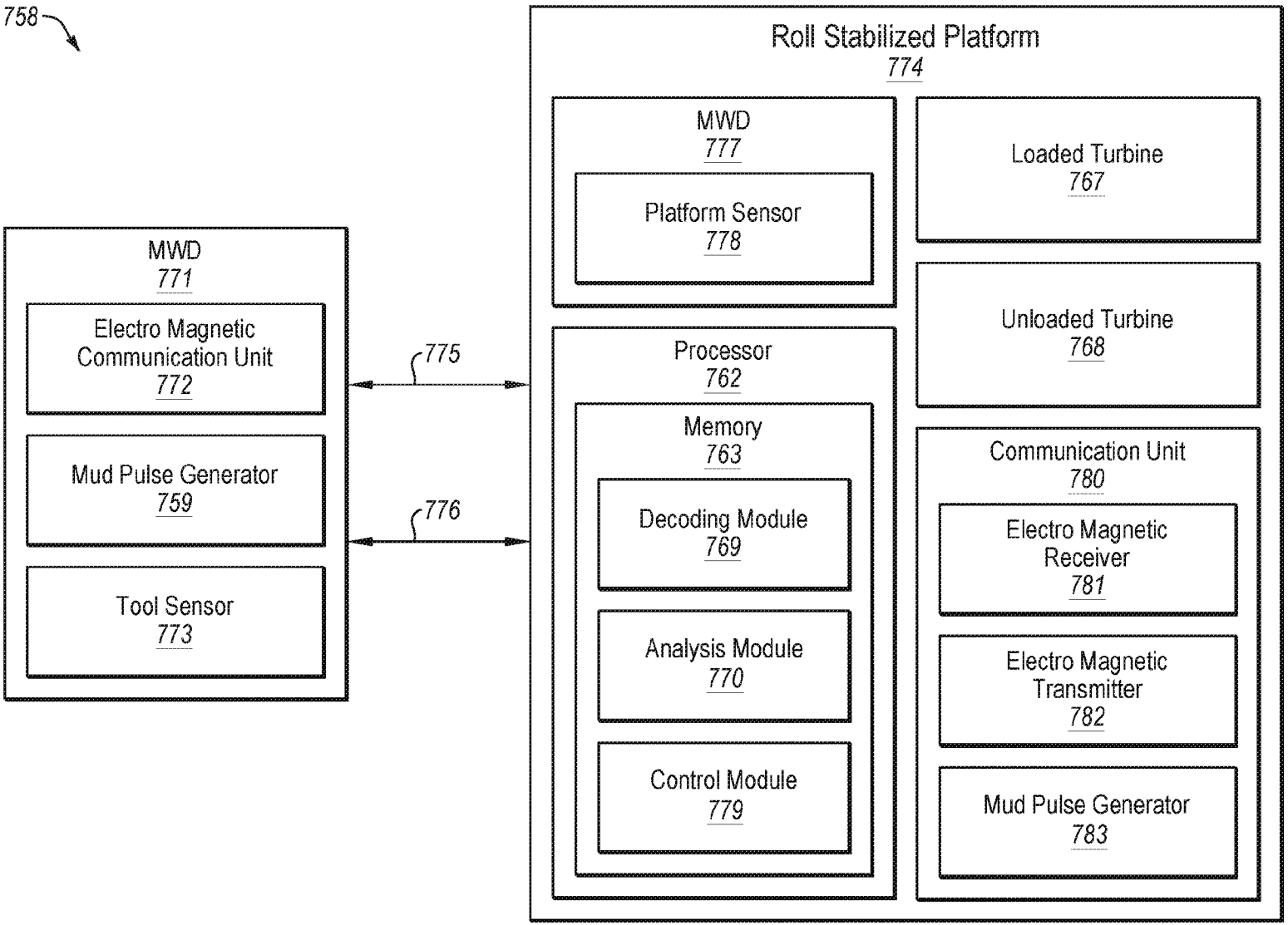
FIG. 7 is yet another schematic representation of a downhole communication system, according to at least one embodiment of the present disclosure.

FIG. 7 is a representation of a downhole communication system 758, according to at least one embodiment of the present disclosure. An MWD 771 may include an electromagnetic communication unit 772, a mud pulse generator 759, and a tool sensor 773. The MWD may communicate with a roll stabilized platform 774 using pressure pulses 775 generated by the mud pulse generator 759 and/or electromagnetic signals 776 generated by the electromagnetic communication unit 772. In some embodiments, the MWD 771 may be an LWD, and including logging as well as measuring functions.

The roll stabilized platform 774 may include a platform MWD 777. The platform MWD 777 may include a platform sensor 778. The roll stabilized platform 774 may include a loaded turbine 767 and an unloaded turbine 768. A processor 762 may access memory 763, the memory including programmed instructions in the form of modules, the instructions causing the processor 762 to perform tasks. A decoding module 769 may cause the processor to determine which turbine of a plurality of turbines is the loaded turbine 767 and which turbine of the plurality of turbines is the unloaded turbine 768. The decoding module 769 may process the rotational rate of the unloaded turbine 768 to determine a hydraulic pressure of a drilling fluid, invert the hydraulic pressure, and demodulate the pressure pulse pattern generated by the mud pulse generator 759.

The roll stabilized platform 774 may include a communication unit 780. The communication unit 780 may include an electromagnetic receiver 781. The electromagnetic receiver 781 may be configured to receive the electromagnetic signals transmitted by the electromagnetic communication unit 772. An electromagnetic transmitter 782 may transmit electromagnetic signals 776 back to the MWD 771. A mud pulse generator 783 connected to the roll stabilized platform may generate pressure pulses 775 that may be transmitted uphole and received by the MWD 771 and at the surface. Thus, the roll stabilized platform 774 and the MWD 771 may have two-way communication between each other.

An analysis module 770 may analyze the data received at the roll stabilized platform 774 by pressure pulse 775 and/or by electromagnetic signal 776. In some embodiments, the analysis module 770 may further analyze data provided by the platform MWD, such as platform measurements from the platform sensor 778. The analysis module 770 may further analyze both the transmitted information and the platform MWD's information in concert. The analysis module 770 may therefore calculate or analyze several wellbore parameters. The control module 779 may then instruct the processor 762 to change one or more drilling parameters.

For example, by analyzing trajectory information at both the MWD 771 and the platform MWD 777, an instantaneous dogleg severity may be calculated. Knowing the instantaneous dogleg severity may help the processor 762 to instruct a rotary steerable system to make trajectory adjustments sooner, which may help the borehole to stay on the projected path. In this manner, hold the curve algorithms may be used to maintain the path of the wellbore. Similarly, by analyzing survey measurements, such as one or more of gamma ray, resistivity, gravimetric, and other survey measurements, the analysis module 770 may determine a formation through which the bit is traveling. This formation may be compared to a target formation, and the trajectory or another drilling parameter may be changed based on the formation through which the bit is traveling.

In some embodiments, the tool sensor 773 and the platform sensor 778 may measure different parameters. Communicating tool measurements to the roll stabilized platform 774 may allow the roll stabilized platform 774 to analyze more information. Furthermore, communicating platform measurements to the MWD 771 may allow the MWD 771 to analyze data collected closer to the bit. This sharing of information may allow for a feedback loop to be created. For example, the MWD 771 may communicate survey data to the roll stabilized platform 774. The roll stabilized platform 774 may use the survey data to change a trajectory of the bit. The changed trajectory of the bit may be communicated back to the MWD 771. The MWD 771 may then analyze the changed trajectory and make one or more measurements based on the new trajectory. The one or more new measurements may be communicated back to the roll stabilized platform 774, which may then change another drilling parameter, and so forth. In some embodiments, this may allow for drilling of the wellbore to be automatic.

Figure 8:
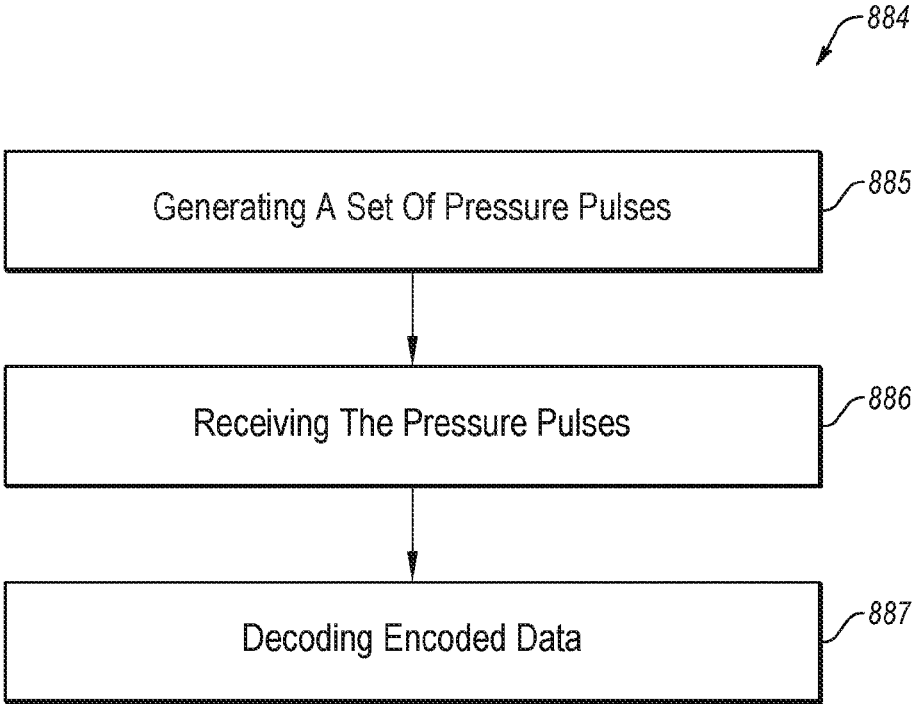
FIG. 8 is a method chart of a method for downhole communication, according to at least one embodiment of the present disclosure.

FIG. 8 is a representation of a method 884 for downhole communication, according to at least one embodiment of the present disclosure. The method 884 may include generating a set of pressure pulses in a pattern at a measuring-while-drilling ("MWD") tool at 885. The pressure pulses may be generated using a mud pulse generator, and the mud pulse generator may encode data in the pressure pulses such that the pattern includes encoded data.

The pressure pulses may be received at a rotary steerable system at 886. A turbine may be rotated with a rotational rate in response to a drilling pressure. Therefore, the turbine may be rotated in response to the pressure pulses. Receiving the pressure pulses may include measuring the rotational rate of the turbine. Because the turbine may be rotatable relative to the pressure, then a first rotational rate may be correlated with a high drilling fluid pressure and a second rotational rate may be correlated with a low drilling fluid pressure.

The method 884 may include decoding the encoded data at the rotary steerable system at 887. Decoding the encoded data may include inverting the pattern of correlated drilling fluid pressures, such that a high drilling fluid pressure is inverted to a low drilling fluid pressure, and a low drilling fluid pressure is inverted to a high drilling fluid pressure. Decoding the encoded data may include demodulating the pattern. In some embodiments, the original pattern may be demodulated, or in other words, a non-inverted pattern may be demodulated. In other embodiments, the inverted pattern may be demodulated. In some embodiments, generating the set of pressure pulses may include the rotary steerable system generating an RSS set of pressure pulses, the RSS set of pressure pulses being directed to the MWD tool.

Figure 9:
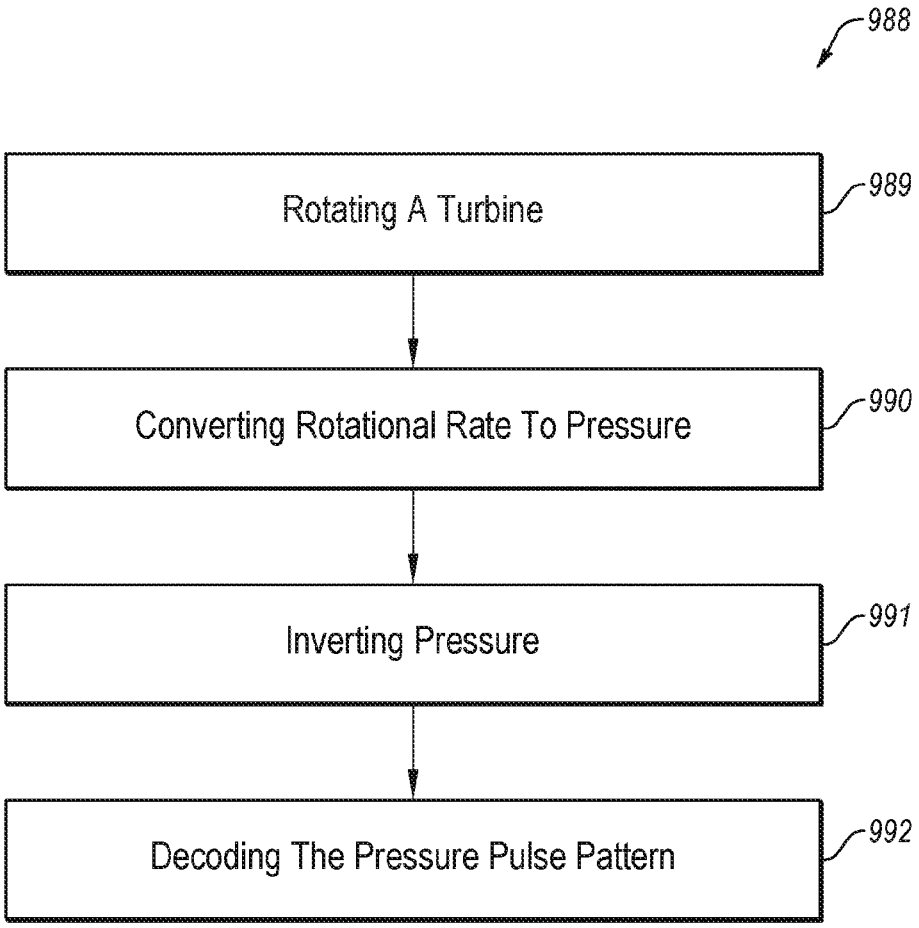
FIG. 9 is a method chart of a method of receiving information from pressure pulses, according to at least one embodiment of the present disclosure.

FIG. 9 is a representation of a method 988 of receiving information from pressure pulses. The method 988 may include rotating a turbine in response to a flow rate, which is related to a drilling pressure at 989. The turbine may be rotated with a rotational rate directly correlated to flow rate and the drilling pressure. Therefore, the turbine may be rotated with a higher rotational rate for higher flow rates and drilling pressures, and with a lower rotational rate for lower flow rates and drilling pressures.

The rotational rate may be converted or correlated to a pressure value at 990. In some embodiments, the pressure value may be representative of the actual pressure drop experienced by the turbine. In other embodiments, the pressure value may be a relative pressure value, the relative pressure value being assigned based on the rotational rate, but not necessarily directly representing any specific pressure value in any specific pressure unit (such as PSI or kPa). Multiple sequential rotational rates may be converted to pressure values. In this manner, a series of pressure pulses may be received by the turbine as a rotational rate and converted to a pressure value.

The pressure values may be inverted at 991. The turbine may be located downhole, or on the low pressure side, of the mud pulse generator that generated the pressure pulses. Inverting the pressure value may convert the correlated pressure values to pressure values similar to those processed by the algorithms used at other pressure pulse receivers, which may be located uphole, or on the high pressure side, of the mud pulse generator. Using the same algorithms may ensure more consistent interpretation of pressure pulse signals.

The method may further include decoding the pressure pulse pattern at 992. In some embodiments, decoding the pressure pulse pattern may include decoding the inverted pressure values. In other embodiments, decoding the pressure pulse pattern may include decoding the non-inverted pressure values. In still other embodiments, decoding the pressure pulse pattern may include decoding the pressure pulse pattern directly from the rotational rate of the turbine.

The embodiments of the downhole communication system have been primarily described with reference to wellbore drilling operations; the downhole communication systems described herein may be used in applications other than the drilling of a wellbore. In other embodiments, downhole communication systems according to the present disclosure may be used outside a wellbore or other downhole environment used for the exploration or production of natural resources. For instance, downhole communication systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole communication system, comprising:

a downhole tool of a bottom hole assembly, the downhole tool configured to control a first mud pulse generator to generate a first set of pressure pulses in a drilling fluid in a first pattern, the first pattern including first encoded data; and a roll stabilized platform downhole from the downhole tool, the roll stabilized platform including:

a turbine rotatable in response to the set of pressure pulses in the drilling fluid;

a processor; and memory, the memory including programmed instructions which, when accessed by the processor, cause the processor to:

decode the first encoded data based on rotation of the turbine; and control the first mud pulse generator or a second mud pulse generator to generate a second set of pressure pulses in the drilling fluid in a second pattern, the second pattern including second encoded data, wherein the downhole tool is configured to decode the second encoded data.

2. The system of claim 1, the programmed instructions, when accessed by the processor, further causing the processor to determine a rotational rate of the rotation of the turbine.

3. The system of claim 2, the programmed instructions, when accessed by the processor, further causing the processor to determine the first pattern based on the rotational rate of the rotation of the turbine.

4. The system of claim 1, the roll stabilized platform being a rotary steerable system.

5. The system of claim 1, the turbine being loaded with an electromechanical load.

6. The system of claim 1, the first encoded data including a drilling instruction to change a drilling parameter of the roll stabilized platform.

7. The system of claim 1, the first encoded data including a drilling instruction for the roll stabilized platform to take a measurement with a sensor.

8. The system of claim 1, the programmed instructions, when accessed by the processor, further causing the processor to analyze the first encoded data.

9. The system of claim 8, the programmed instructions, when accessed by the processor, further causing the processor to change a drilling parameter based on the analysis of the first encoded data.

10. A downhole communication system, comprising:

a downhole tool of a bottom hole assembly, the downhole tool configured to control a first mud pulse generator to generate a first set of pressure pulses in a first pattern, the first pattern including first encoded data; and a rotary steerable system downhole from the downhole tool, the rotary steerable system including:

an unloaded turbine configured to rotate in response to the first set of pressure pulses;

a loaded turbine, the loaded turbine being loaded with an electromechanical load;

a processor; and memory, the memory including programmed instructions which, when accessed by the processor, cause the processor to:

determine the unloaded turbine;

measure a rotational rate of the unloaded turbine;

decode the first encoded data based on the rotational rate of the unloaded turbine; and control the first mud pulse generator or a second mud pulse generator to generate a second set of pressure pulses in a second pattern, the second pattern including second encoded data, wherein the downhole tool is configured to decode the second encoded data.

11. The downhole communication system of claim 10, the programmed instructions including steering instructions, the steering instructions, when accessed by the processor, causing the processor to change a trajectory of the rotary steerable system based at least in part on the first encoded data.

12. The downhole communication system of claim 10, the downhole tool including an electromagnetic transmitter, the rotary steerable system including an electromagnetic receiver, the electromagnetic communication transmitter being configured to transmit the first encoded data via an electromagnetic signal to the electromagnetic receiver.

13. A method for downhole communication, the method comprising:

controlling, by a downhole tool of a bottom hole assembly, a first mud pulse generator to generate a first set of pressure pulses in a first pattern, the first pattern including first encoded data;

receiving the first set of pressure pulses at a rotary steerable system;

determining an unloaded turbine of the rotary steerable system;

measuring a rotational rate of the unloaded turbine;

decoding, at the rotary steerable system, the first encoded data of the unloaded turbine;

controlling the first mud pulse generator or a second mud pulse generator to generate a second set of pressure pulses in a second pattern, the second pattern including second encoded data; and decoding the second encoded data at the downhole tool.

14. The method of claim 13, wherein measuring the rotational rate of the unloaded turbine includes correlating a first rotational rate of the unloaded turbine with a high drilling fluid pressure and a second rotational rate of the unloaded turbine with a low drilling fluid pressure.

15. The method of claim 13, wherein decoding the first encoded data includes inverting the first pattern.

16. The method of claim 13, wherein decoding the first encoded data includes demodulating the first pattern.

* * * * *